United States Patent [19]

Paul

[11] 4,236,810

[45] Dec. 2, 1980

[54] MEANS FOR INHIBITING THE SEPARATION OF TONER PARTICLES FROM DISPERSANT IN A COPY MACHINE

[75] Inventor: Samuel J. Paul, Ardsley, Pa.

[73] Assignee: Sperry Corporation, New York, N.Y.

[21] Appl. No.: 68,265

[22] Filed: Aug. 20, 1979

[51] Int. Cl.[3] ..... G03G 15/10

[52] U.S. Cl. ..... 355/10; 118/662; 118/700; 118/DIG. 5; 355/14 D; 355/3 R

[58] Field of Search ..... 355/10, 14 D, 3 R; 118/662, 429, 696, 699, 700, 706, DIG. 5

[56] References Cited

U.S. PATENT DOCUMENTS 3,811,914 5/1974 Saito et al. ..... 355/10 X 3,957,368 5/1976 Goshima et al. ..... 355/10 X

*Primary Examiner*—R. L. Moses

*Attorney, Agent, or Firm*—Edward M. Farrell; Thomas J. Scott; William E. Cleaver

[57] ABSTRACT

This invention includes timer means in combination with switching means disposed in a copying machine for cyclically and automatically activating a pump which circulates liquid developer through the copying machine for a predetermined period of time thereby periodically mixing the toner particles and dispersant in the liquid developer while also rotating the copier drum through an incremental angle thereby periodically immersing each section of the drum surface in the liquid developer reservoir.

7 Claims, 1 Drawing Figure

MEANS FOR INHIBITING THE SEPARATION OF TONER PARTICLES FROM DISPERSANT IN A COPY MACHINE

BACKGROUND OF THE INVENTION

Timers for automatic switching have been used extensively in copy machines. Such timers have been used to automatically discontinue the operation of various devices within predetermined times after manually starting or after a malfunction occurs in the machine. Some such devices controlled by timers in copy machines include pumps, motors, and other components. The operation of these devices is automatically terminated by a timer after predetermined time intervals or because of faulty operation.

Copy machines used heretofore of the type involving the present invention include a liquid electrostatic developer and a rotatable drum having a photoconductive surface. The surface of the drum is first moved past a charging station and an image to be copied is projected onto the surface of the drum at an exposure station forming a latent electrostatic image thereon. The drum is then rotated through a reservoir which contains a liquid developer having charged toner particles suspended in a suitable carrier liquid or dispersant. After rotation through the reservoir the drum has a developed electrostatic image on its surface produced as a result of the toner particles being attracted to the latent image on the drum. Next, the drum is brought in contact with paper where the toner is transferred from the surface of the drum onto the paper. Electrostatic liquid developer systems of the type described have been disclosed and described in greater detail in numerous patents and publications.

One of the problems with this type of copy machine involves the liquid developer through which the drum passes. The liquid developer, as mentioned above, includes a dispersant or liquid carrier and charged toner particles in solution. A pump, actuated by an operator closing a power-on switch, is employed to circulate the developer prior to making copies to assure that the toner particles are suitably mixed with the dispersant.

When the copy machine is not operated over relatively long periods of time, the liquid developer is not circulated and the toner particles tend to settle out of solution, i.e., separate from the dispersant. The surfaces of the pump, tubes, and drum in the copy machine in contact with the liquid developer, become coated with grit because of the build-up of the separated toner particles. In addition, the toner particles in the reservoir tend to settle to the bottom forming a thick, sticky residue. The creation of grit particles on the drum surfaces results in poor quality copies and the build-up of separated toner particles on the surfaces of the pump and tubes and bottom of the reservoir requires expensive and time consuming cleaning operations. It has been found in practice, that this problem generally develops during long periods of non-use of the copy machine, such as during weekends and holidays in places of business where such machines are used.

Another aspect of the problem associated with the non-circulation of the liquid developer over long periods of time results from the lack of immersion of a portion of the surface area of the drum in reservoir containing the liquid developer. The exposed portion of the drum surface tends to build up a coating of particles because it is not immersed in the carrier liquid. After a prolonged period of exposure the grit build-up on this portion is not readily dissolved during subsequent immersion in the liquid carrier.

SUMMARY OF THE INVENTION

The subject invention provides means for periodically and automatically circulating the liquid developer in a copy machine when the machine is not in use for protracted periods of time. Further this invention provides means for periodically and automatically rotating the copier drum through an incremental angle thereby immersing each of the sections on the surface of the drum for approximately equal periods of time when the machine is not in use for protracted time periods.

Copy machines for which the present invention is provided include a power-on switch that is manually actuated to connect a source of power to a pump for circulating the liquid developer through the reservoir and associated tubing while also connecting the source of power to a motor which rotates the druum. A timer maintains the power-on switch in the normally closed position for a predetermined time interval after it has been manually actuated. A second switch is connected in parallel with the manually operated switch. A timing motor including a clutch and a cam are disposed to periodically close the second switch for predetermined time intervals to rotate the drum and to operate the pump thereby circulating the liquid developer which effectively self cleans the surfaces of the pump, tubes and drum in contact with the developer while also minimizing the build-up of the thick, sticky residue of toner particles on the bottom of the reservoir.

Other advantages of the present invention will be apparent and suggest themselves to those skilled in the art, from a reading of the following specification and claims, taken in conjunction with the accompanying drawing.

BRIEF DESCRIPTION OF THE DRAWING

The sole FIGURE in the drawing illustrates a liquid electrostatic developer copy machine, partly in schematic form, including means for automatically and periodically circulating the developer.

DESCRIPTION OF THE PREFERRED EMBODIMENT

Figure 1:
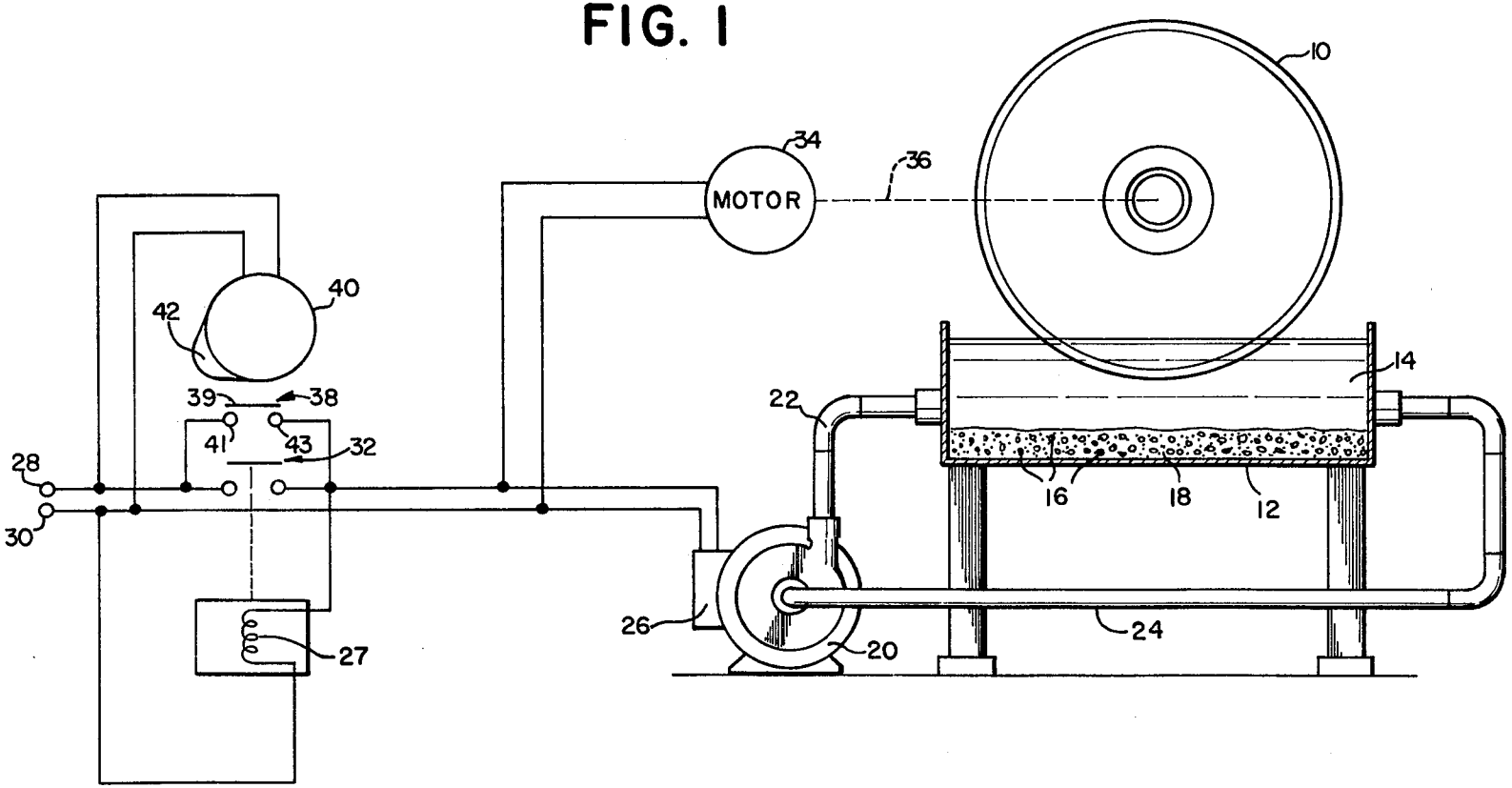

Referring to the sole FIGURE, a drum 10 is disposed to rotate through a reservoir 12 containing a liquid developer 14. The drum 10 may be of the electrostatic type used in many conventional copier machines of the type to which previous reference has been made. The various devices for producing the image on the drum and for copying the developed image on paper are not illustrated because they are well known and only incidentally related to the present invention.

The liquid developer 14 consists of toner particles 16 which are carried in a liquid dispersant 18. During a copying operation, a pump 20 normally circulates or pumps the liquid developer 14 through a tube or pipe 22, the reservoir 12 and back to the pump 18 through a tube 24. The liquid developer 14 is circulated by the pump 20 each time the copy machine is turned on as hereinafter described. The circulation generally continues for a predetermined time period at which time the machine will automatically shut off and the circulation will be discontinued. In most machines, the circulation must take place for a sufficient time period to assure proper mixture of the toner particles 16 and liquid dispersant 18 before copies can be made.

The pump 20 is driven by an electric motor 26 when power is applied thereto. A source of power (not shown) which may be a conventional A.C. source, is connected to input terminals 28 and 30. A manually operated power-on switch 32 is normally open and closes when actuated. When the switch 32 is closed, power is applied to the motor 26 from the input terminals 28 and 30 to actuate the pump 20 and circulate the liquid developer 14. At the same time, when the switch 32 is closed, power is applied to a motor 34 which is connected through a suitable shaft or other drive means illustrated by the dotted line 36, to rotate the drum 10.

When the switch 32 is actuated, input power applied from the input terminals 28 and 30 is coupled through a timer relay 38. The function of the timer relay 27 is to maintain the switch 32 closed for a predetermined time after it has been actuated. In the absence of other overriding conditions, the relay 27 will automatically return the power-on switch 32 to the open position after a predetermined time period. The timer relay 38 may be of the current sensitive type and are commercially available and well known to those skilled in the art. Such relays are designed to open or close at any desired time intervals.

In a typical embodiment, the timer relay 38 is designed to operate for about sixty seconds. This means that once the switch 32 is closed, power will be applied to the motors 26 and 34 and the liquid developer 14 will be circulated for sixty seconds. Further, energizing the motor 34 produces rotation of the drum 10 by approximately one quarter of a revolution so that the immersed portion of the drum 10 is rotated out of the liquid developer 14 in the reservoir 12. The details of the system described thus far are found in commercially available prior art copy machines such as, for example, copier Model 770 manufactured by Savin, Inc.

In the system thus far described, if the switch 32 is maintained in an open state for protracted periods of time, the motors 26 and 34 will not be energized, the liquid developer 14 will not be circulated by the pump 20, the drum 10 will remain stationary with the same portion of the drum surface exposed to allow grit particles to form thereon, and the toner particles 16 in the liquid developer 14 will settle to the bottom of the reservoir 12. As previously mentioned, under these conditions, grit also tends to build up and clog the tubes 20 and 24, and coat the surfaces of the pump 20 exposed to the liquid developer 14. On occasion it has been noted that the grit build up on the pump surfaces has been so great as to cause the pump 20 to malfunction. Although pump failure is infrequent, the deleterious effect on the quality of the copies produced by the grit build-up has been noted to be a continuing problem. As a result, to obtain good quality copies it is necessary to provide more frequent maintenance which includes disassembling the machine to scrape off the grit build-up in the tubes 20, 24 the reservoir 12 and exposed surfaces of the pump 20. Further, the drum 10 also requires frequent cleaning in a suitable solvent.

The present invention significantly reduces the frequency of such maintenance while minimizing the time required for cleaning. The invention provides means for periodically and automatically providing power to the motors 26, 34 by incorporating a second normally open switch 38 connected across or in parallel with the switch 32 and a second timer motor 40 which is operated by power applied from the terminals 28 and 30. The motor 40 may be of the type that will rotate at any desired speed with a preferred embodiment being rotatable at a speed of one revolution per hour. Such motors are commercially available from General Time, Inc. for example.

The motor 40 includes a clutch (not shown) and a cam element 42 which is rotated thereby. The cam element 42 is disposed to be moved in close proximity to and physically engage an arm 39 of the switch 38 for each revolution of the timer motor 40. When the cam element 42 contacts the arm 39, the arm closes across contacts, 41 and 43. Power is then applied from terminals 28 and 38, through the switch 30, to actuate motors 26 and 34. The pump 20 then circulates the liquid developer 14 and the drum 10 rotates one quarter of a revolution.

The liquid developer 14 is circulated for a predetermined period of time dependent on how long the switch 38 is closed. This in turn is dependent upon the width of the cam element 42. In a preferred embodiment the size of the cam element 42 may be such so as to maintain the switch 38 closed for sixty seconds, although different time invervals may be desired for different systems. It has been found that the periodic energization of the motors 26 and 34 for sixty seconds each hour with the resultant circulation of the developer 14 and rotation of the drum 10 is sufficient to provide self-cleaning of the surfaces of the pump, tubes, reservoir and drum and significantly reduce the frequency and extent of maintenance for such copier machines. This has resulted in minimized down-time, improved quality of the copies produced and a substantial saving in the cost of operation.

I claim:

1. In a copy machine including a reservoir containing a liquid developer consisting of toner particles in a dispersant, a source of voltage, a power-on switch coupled to said voltage source, a timer relay adapted to maintain said power-on switch closed for a predetermined period of time after actuation of said switch, a copier drum, first motor means coupled to said switch for rotating said copier drum in response to each actuation of said switch, a pump and interconnecting tubes coupled to said reservoir, second motor means coupled between said switch and said pump for activating said pump to circulate said liquid developer through said interconnecting tubes and said reservoir for said predetermined period of time, an improvement for inhibiting the separation of toner particles from said dispersant during periods of non-use comprising:

second switch means coupled to said power-on switch, timing motor means coupled to said source of voltage, and means coupled to said timing motor for periodically actuating said second switch whereby said first and second motor means will be actuated to rotate said copier drum and to activate said pump thereby circulating said liquid developer.

2. The combination as set forth in claim 1 wherein said first motor means rotates said copier drum through an angular displacement of approximately 90° in response to each actuation of said first motor means.

3. The combination as set forth in claim 1 wherein said second switch means includes a pair of normally open contacts connected in parallel with said power-on switch.

4. The combination as set forth in claim 1 wherein said means coupled to said timing motor includes a cam element for periodically actuating said second switch.

5. The combination as set forth in claim 4 wherein said cam element maintains said second switch periodically closed for sufficient time durations determined from the constituent elements of the liquid developer to prevent said toner particles from separating from said liquid carrier thereby preventing the formation of grit on the surfaces of said pump, tubes, drum and bottom of said reservoir.

6. The combination as set forth in claim 4 wherein said timing motor is rotated at a rate of approximately one revolution per hour and said cam element maintains said second switch closed for a time duration of about sixty seconds per hour.

7. The combination as set forth in claim 1 wherein said drum is disposed to be rotated so that a portion of its surface is always in said liquid developer and said first motor is coupled to said source of power when either said power-on or said second switch is closed to cause said drum to be rotated less than one revolution so that a different portion of the surface of said drum is immersed in said liquid developer within said reservoir.

* * * * *